United States Patent [19]

Fleagle

[11] 4,319,534

[45] Mar. 16, 1982

[54] DINGHY COCKPIT

[76] Inventor: Barry K. Fleagle, 108 Linden Ave., Frederick, Md. 21701

[21] Appl. No.: 130,612

[22] Filed: Mar. 17, 1980

[51] Int. Cl.[3] ..... B63H 9/00

[52] U.S. Cl. ..... 114/39; 114/71; 114/77 R; 114/352; 114/348; 441/126

[58] Field of Search ..... 9/1.5, 2 S, 12, 1.1, 9/7, 3; 114/39, 71, 77 R, 77 A

[56] References Cited

U.S. PATENT DOCUMENTS

| | | | |
|---|---|---|---|
| 1,509,945 | 9/1924 | Fuchs | 114/77 R X |
| 3,634,897 | 1/1972 | Cuccio | 9/1.1 |
| 3,734,047 | 5/1973 | Burton | 9/1.5 X |
| 4,036,520 | 7/1977 | Zuidema | 9/1.1 |

*Primary Examiner*—Ralph J. Hill

[57] ABSTRACT

A boat dingy which also serves as a cockpit while the boat is underway and as a cabin top when the boat is moored.

2 Claims, 1 Drawing Figure

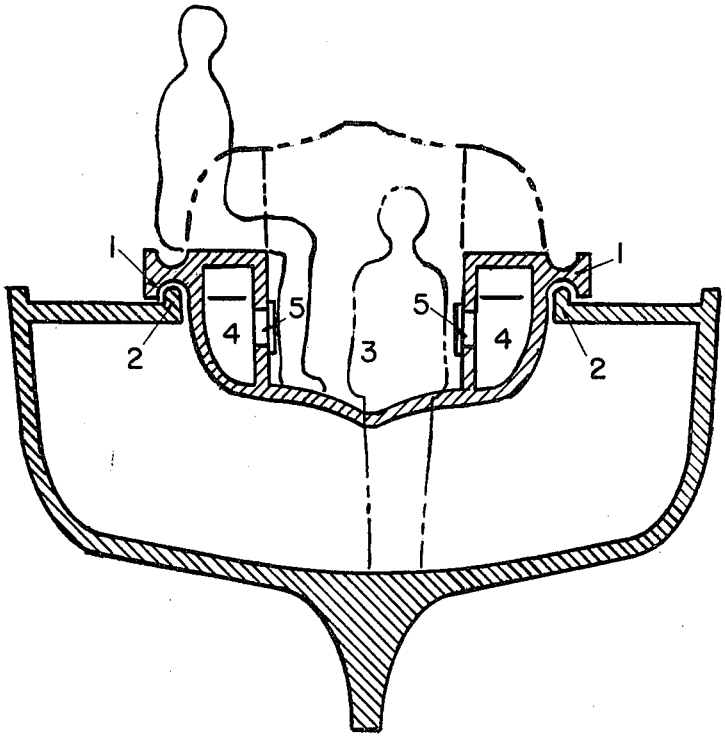
1
1
2
2
3
4
4
5
5

DINGHY COCKPIT

SUMMARY

The dinghy of this invention serves as a cockpit while the boat is underway by fitting into a hatch opening in the deck of the boat; the interior of the dinghy seating the crew. The dinghy of this invention also serves as a cabin top while the boat is moored by fitting inverted over the same hatch opening in the deck of the boat; the interior of the dinghy providing head-room. In prior art, allowances for the storage of a dinghy can not be made on small boats. Hence many dinghys are lashed precariously on deck, towed, or left on the dock. By utilising the dingy as a cockpit this invention solves this problem. Also in prior art the space below the cockpit is wasted, used only for storage. By utilising the dingy as a cabin top this invention solves this problem.

DRAWING

The drawing shows a cross-section through the beam of the dinghy and the boat. The dinghy's position as a cockpit and the outline of a person utilising it are shown in solid lines. The dinghy's position as a cabin top and the outline of a person utilising it are shown in phantom lines.

EMBODIMENT

The dinghy has a female flange (1) which fits over the male flange (2) around the deck opening. The central area of the dinghy (3) serves as leg-room when the dinghy is used as a cockpit and as head room when the dinghy is used as a cabin top. Sealed tanks on the side of the dinghy (4) serve as seats when the dinghy is used as a cockpit, as flotation tanks when the dinghy is used as a dinghy, and as cabinets (access is through sealed inspection plates (5)) when the dinghy is used as a cabin top.

I claim:

1. In a water born sailing vessel including a hull and a deck having a cockpit for the helmsman and passengers of the vessel, the improvement which comprises: an opening in said deck the shape and size and position of the cockpit; a removable member stowable in said opening and forming the cockpit when so stowed for the helmsman and passengers of the vessel and said member when in an inverted position and located over the same said opening forming a cabin top, said member being an integral portion of the deck in either the normal or inverted position.

2. The improvement of claim 1 wherein the forward portion of said member is shaped as a prow of a dinghy and the seats of said member are floatation tanks and said member when detached from the vessel forms a dinghy.

* * * * *